US005596940A

United States Patent [19]

Yamada et al.

[11] Patent Number: 5,596,940

[45] Date of Patent: Jan. 28, 1997

[54] APPARATUS FOR TREATING END PORTION OF SEWING THREAD

[75] Inventors: Takahiro Yamada, Toyoake; Masao Ogawa; Eiji Shibata, both of Nagoya, all of Japan

[73] Assignee: Brother Kogyo Kabushiki Kaisha, Nagoya, Japan

[21] Appl. No.: 572,712

[22] Filed: Dec. 14, 1995

[30] Foreign Application Priority Data

Dec. 22, 1994 [JP] Japan ..... 6-320548

[51] Int. Cl.[6] ..... D05B 87/02

[52] U.S. Cl. ..... 112/225; 112/253

[58] Field of Search ..... 112/224, 225, 112/253, 295, 302; 223/99

[56] References Cited

FOREIGN PATENT DOCUMENTS 61-35188 10/1986 Japan .

3-133484 6/1991 Japan .

*Primary Examiner*—Ismael Izaguirre

*Attorney, Agent, or Firm*—Oliff & Berridge

[57] ABSTRACT

Apparatus for treating an end portion of a sewing thread which is supplied from a thread supplying device and is guided by a guiding device to pass near a sewing needle of a sewing head of a sewing machine, the sewing head having a front surface facing a user who operates the sewing machine, a rear surface opposite to the front surface, and a side surface connecting between the front and rear surfaces, the apparatus including a downstream holding device which holds the end portion of the sewing thread guided by the guiding device, so as to stretch a portion of the sewing thread near the sewing needle, and a cover member which covers the sewing head, the cover member providing the front, rear, and side surfaces of the sewing head, the downstream holding device being provided on a visible portion of the side surface of the cover member which portion is visible from the user facing the front surface of the cover member.

20 Claims, 8 Drawing Sheets

APPARATUS FOR TREATING END PORTION OF SEWING THREAD

BACKGROUND OR THE INVENTION

1. Field of the Invention

The present invention relates to an apparatus for treating an end portion of a sewing thread supplied from a thread supplying device of a sewing machine.

2. Related Art Statement

There is known a sewing machine having a threading device. Before commencement of sewing operation of the sewing machine, a needle thread is drawn from a thread supplying device by a user, and an end portion of the thread is put through an eye hole of a sewing needle by the threading device. While the thread end is pulled and tensioned, the needle is moved down and up to draw a bobbin thread from a bobbin. The needle and bobbin threads are placed side by side and conveyed to a thread cutter provided on a cover member of a sewing head or a throat plate having a throat through which the needle is moved vertically.

An example of the above-indicated thread-end treating device is disclosed in Unexamined Japanese Patent Application laid open for inspection under Publication No. 3(1991)-133484. The disclosed device treats, before commencement of a sewing operation of a sewing machine including a threading device which puts a sewing thread through an eye hole of a sewing needle, an end portion of the sewing thread so that a predetermined length of the thread is drawn out through the needle eye. The prior device includes (a) a guiding device which guides, along a thread-guiding route passing near the sewing needle, the sewing thread supplied from a thread supplying device before the commencement of the sewing operation of the sewing machine, the guiding device including a guiding member which is provided in the thread-guiding route and which engages the sewing thread supplied from the thread supplying device; (b) an intermediate holding device which is provided on a downstream side of the guiding member in the thread-guiding route and which holds the sewing thread with a biasing force applied substantially perpendicularly to the thread-guiding route; and (c) a cutting device which is provided on a downstream side of the intermediate holding device in the thread-guiding route and which cuts off an excessive length of the end portion of the sewing thread held by the intermediate holding device, at a position distant by a predetermined distance from the guiding member in the thread-guiding route. The guiding member is movable toward the sewing needle to stretch a portion of the sewing thread in front of the needle eye, so that the sewing thread is put through the needle eye by the threading device of the sewing machine.

The thread-end treating operation of the above-identified thread-end treating device is described below by reference to FIGS. 7A and 7B. Before commencement of the sewing operation, a user picks up an end of a sewing thread T drawn from a thread supplying device (not shown), and stretches the thread T along a thread guiding route 101, 103 such that first the thread T is engaged with a thread engaging device 105 and subsequently is held by a movable holding device 107. The movable holding device 107 holds the thread T with a holding force applied substantially perpendicular to the thread guiding route. After the sewing thread T is further guided downstream along the thread guiding route 101, 103, the thread T is tensioned and an excessive length of the thread T is cut off on a thread cutting device 109 which is provided at a position distant by a predetermined distance from the thread engaging device 105 in the thread guiding route. In order to put the sewing thread T through an eye hole 199 of a sewing needle 197, the thread engaging device 105 with which the thread T is engaged is moved toward, and stopped adjacent, the needle eye 199. In this state, the thread engaging device 105 and the movable holding device 107 are distant from each other by a predetermined distance. Therefore, a predetermined length of the thread T is obtained between the cut end thereof and the thread engaging device 105 positioned adjacent to the needle eye 199. Accordingly, the predetermined length of thread T can be drawn out through the needle eye 199.

However, in the prior device, the thread cutting device 107 is provided in the back of a sewing head 117, as shown in FIG. 7B. Thus, the user who faces a front surface of the sewing head 117 cannot cut the sewing thread T while actually viewing the thread end T and the cutting device 109. The user must move around to the back of the sewing machine or otherwise feel his or her way to cut the thread T on the cutting device 109. Accordingly, the reliability and operability of the prior device are not satisfactory.

SUMMARY OF THE INVENTION

It is therefore an object of the present invention to provide a thread-end treating apparatus which is employed in a sewing machine and which enjoys improved reliability and operability.

According to a first aspect of the present invention, there is provided an apparatus for treating, before commencement of a sewing operation of a sewing machine including a threading device which puts a sewing thread through an eye hole of a sewing needle, an end portion of the sewing thread so that a predetermined length of the thread is drawn out through the needle eye, the apparatus comprising a guiding device which guides, along a thread-guiding route passing near the sewing needle, the sewing thread supplied from a thread supplying device before the commencement of the sewing operation of the sewing machine, the guiding device including a guiding member which is provided in the thread-guiding route and which engages the sewing thread supplied from the thread supplying device; an intermediate holding device which is provided on a downstream side of the guiding member in the thread-guiding route and which holds the sewing thread with a biasing force applied substantially perpendicularly to the thread-guiding route; a cutting device which is provided, on a downstream side of the intermediate holding device in the thread-guiding route, at a position around a visible side surface of the sewing machine, and which cuts off an excessive length of the end portion of the sewing thread held by the intermediate holding device, at the position distant by a predetermined distance from the guiding member in the thread-guiding route; and a downstream holding device which is provided on an upstream side of the cutting device, and on a downstream side of the intermediate holding device, in the thread-guiding route and which holds a remaining end portion of the sewing thread cut by the cutting device, the guiding member being movable toward the sewing needle to stretch a portion of the sewing thread in front of the needle eye, so that the sewing thread is put through the needle eye by the threading device of the sewing machine.

In the thread-end treating apparatus in accordance with the first aspect of the present invention, the sewing thread drawn from the thread supplying device before the commencement of the sewing operation is guided along the thread guiding route such that first the thread is engaged with the guiding member of the guiding device and subsequently is held by the intermediate holding device. The sewing thread is further drawn in a downstream direction along the thread guiding direction, so that the thread is held by the downstream holding device and an excessive length of the thread is cut by the cutting device provided on the downstream side of the downstream holding device. Since the sewing thread is held by the downstream holding device, the user may, or may not, cut the excessive length of the thread T on the cutting device. In either case, the thread is securely held by the downstream holding device. The thread is easily cut by slightly pulling the thread from the downstream holding device, thereby tensioning the thread, and introducing the thread onto the cutting device. Since the cutting device is provided at the position around the visible side surface of the sewing machine, the user can carry out the thread cutting operation while viewing the sewing thread and the cutting device in sight. Therefore, the reliability and operability of the present thread-end treating apparatus are very high as compared with those of the prior device shown in FIGS. 7A and 7B.

According to a second aspect of the present invention, there is provided an apparatus for treating an end portion of a sewing thread which is supplied from a thread supplying device and is guided by a guiding device to pass near a sewing needle of a sewing head of a sewing machine, the sewing head having a front surface facing a user who operates the sewing machine, a rear surface opposite to the front surface, and a side surface connecting between the front and rear surfaces, the apparatus comprising a downstream holding device which holds the end portion of the sewing thread guided by the guiding device, so as to stretch a portion of the sewing thread near the sewing needle; and a cover member which covers the sewing head, the cover member providing the front, rear, and side surfaces of the sewing head, the downstream holding device being provided on a visible portion of the side surface of the cover member which portion is visible from the user facing the front surface of the cover member.

In the thread-end treating apparatus in accordance with the second aspect of the present invention, a thread cutting device may, or may not, be provided on the visible portion of the side surface of the sewing head. In the former case, the present apparatus enjoys the same advantages as those with the apparatus in accordance with the first aspect of the invention. Even in the latter case, the user can engage the sewing thread with the downstream holding device while viewing both the thread and the holding device, so that the thread is securely held by the holding device. Thus, the sewing thread stretched near the sewing needle can easily be drawn through an eye hole of the sewing needle by a threading device of the sewing machine.

According to a preferred feature of the second aspect of the invention, the side surface of the cover member comprises a substantially flat surface which is substantially perpendicularly connected to each of the front and rear surfaces of the cover member. Alternatively, the side surface of the cover member may comprise a curved surface. In the latter case, the curved surface of the cover member may comprise a part-cylindrical surface, and the visible portion of the side surface may comprise a front half of the part-cylindrical surface on a side of the front surface, and a portion of a rear half of the part-cylindrical surface which portion has a maximum tangent-plane angle of 30 degrees with respect to a reference plane parallel to the sewing needle and perpendicular to the front and rear surfaces parallel to each other. It is preferred that the visible portion of the side surface comprise a portion of the rear half of the part-cylindrical surface which portion has a maximum tangent-plane angle of 15 degrees with respect to the reference plane.

According to a third aspect of the present invention, there is provided an apparatus for treating an end portion of a sewing thread which is supplied from a thread supplying device and is guided by a guiding device along a thread-guiding route passing near a sewing needle of a sewing head of a sewing machine, the sewing head having a front surface facing a user who operates the sewing machine, a rear surface opposite to the front surface, and a side surface connecting between the front and rear surfaces, the apparatus comprising an upstream holding device which is fixed on an upstream side of the sewing needle in the thread guiding route and which holds, with a first holding force, the sewing thread supplied from the thread supplying device; a downstream holding device which is fixed on a downstream side of the upstream holding device in the thread guiding route and which holds the end portion of the sewing thread; and a movable holding device which is provided between the upstream and downstream holding devices in the thread guiding route and which holds the sewing thread with a second holding force smaller than the first holding force, the movable holding device cooperating with the upstream holding device to stretch a portion of the sewing thread near the sewing needle, the movable holding device being movable away from the upstream holding device to a downstream-side position thereof so as to tension the stretched portion of the sewing thread.

In the thread-end treating apparatus in accordance with the third aspect of the present invention, a thread cutting device may, or may not, be provided on a downstream side of the downstream holding device and on a visible portion of the side surface of the sewing head. In the former case, the present apparatus enjoys the same advantages as those with the apparatus in accordance with the first aspect of the invention. Even in the latter case, the user can engage the sewing thread with the downstream holding device while viewing both the thread and the holding device, so that the thread is securely held by the holding device. Thus, the sewing thread stretched and tensioned near the sewing needle can easily be drawn through an eye hole of the sewing needle by a threading device of the sewing machine.

According to a preferred feature of the third aspect of the invention, the downstream holding device holds the end portion of the sewing thread with a third holding force smaller than the second holding force of the movable holding device, the movable holding device being movable away from the downstream-side position thereof near to the downstream holding device, to an upstream-side position thereof so as to draw the end portion of the sewing thread held by the downstream holding device. In this case, the downstream holding device may hold the end portion of the sewing thread such that not more than a predetermined length of the thread is obtained beyond the downstream holding device, the predetermined length being equal to a distance of movement of the movable holding device from the downstream-side position thereof to the upstream-side position thereof. The thread-end treating apparatus may further comprise a cutting device which is provided at a position distant by not more than the predetermined length from the downstream holding device, and which cuts an excessive length of the end portion of the sewing thread held by the downstream holding device, so that when the movable holding device is moved from the downstream-side position thereof to the upstream-side position thereof, the cut end portion of the sewing thread is drawn out of the downstream holding device. The downstream holding device and the cutting device may be provided on a visible portion of the side surface of the sewing head which portion is visible from the user facing the front surface of the sewing head.

According to another feature of the third aspect of the invention, the thread-end treating apparatus may comprise a guiding member of the guiding device, the guiding member being provided between the upstream holding device and the movable holding device in the thread guiding route, wherein when the movable holding device is moved away from the upstream holding device to the downstream-side position thereof, the movable holding device is moved away from the guiding member and the guiding member is moved toward the sewing needle, so as to tension the stretched portion of the sewing thread. In this case, the movable holding device may be provided at a position which is between the guiding member and the downstream holding device in the thread guiding route and is as high as a position of the guiding member, the guiding member and the movable holding device being movable, as a unit, downward along the sewing needle to a level of the eye hole of the needle, the guiding member being further movable to a position adjacent to the eye hole of the needle, so that the end portion of the sewing thread is put through the eye hole of the needle by a threading device of the sewing machine. The guiding member and the movable holding device may be supported by a movable bar of the threading device which bar extends parallel to a vertically movable needle bar to which the sewing needle is secured, is vertically movable along the sewing needle, and is rotatable about an axis line thereof to move the guiding member toward the sewing needle and move the movable holding device away from the guiding member, the guiding device and the second holding device providing respective parts of the threading device, the movable holding device being located on a front side of the downstream holding device on which side the user operates the sewing machine.

According to yet another feature of the third aspect of the invention, the movable holding device comprises two holding members which cooperate with each other to hold the end portion of the sewing thread; an axis member which extends through one of the two holding members, the sewing thread being partially wound around the axis member; and a biasing member which biases, with the second holding force, the one holding member along the axis member toward the other holding member, so that the sewing thread partially wound around the axis member is held between the two holding members. The other holding member of the movable holding device may include a horizontal portion and an inclined portion inclined downward from the horizontal portion, and wherein when the movable holding device is moved downward along the sewing needle toward a level of the eye hole of the needle, the sewing thread held by the second holding device slides, because of an increased tension thereof, on the inclined portion of the other holding member toward the axis member, so that the sewing thread is held between the two holding members. The other holding member of the movable holding device may have a thread groove which permits, when the sewing thread falls therein, the sewing thread to easily be drawn from the movable holding device, so that the end portion of the sewing thread is put through the eye hole of the sewing needle by a threading device of the sewing machine. The inclined surface of the other holding member is inclined such that when the guiding member and the movable holding device are moved as a unit along the sewing needle toward a level of the eye hole of the needle, one of the opposite end portions of the other holding member which portion is nearer to the guiding member than the other end portion goes ahead of the other end portion of the other holding member which portion is nearer to the downstream holding device than the one end portion, so that the sewing thread held by the second holding device slides, because of the increased tension thereof, on the inclined portion of the other holding member toward the axis member.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 2:
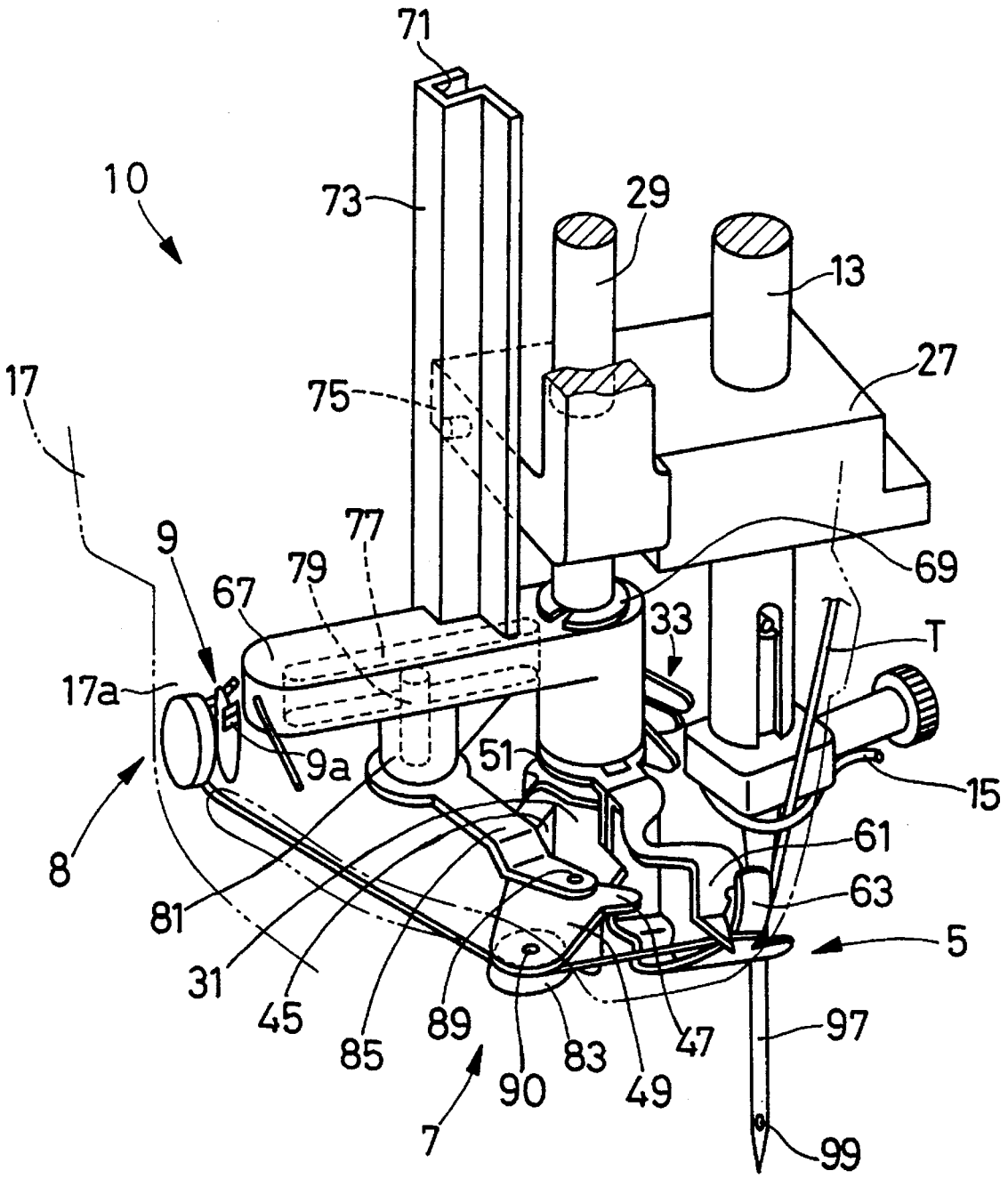
FIG. 2 is a perspective view of a threading apparatus which includes the thread-end treating apparatus of FIG. 1.

Referring first to FIG. 2, there is shown a thread-end treating apparatus 10 of a sewing machine to which the present invention is applied.

Figure 1A:
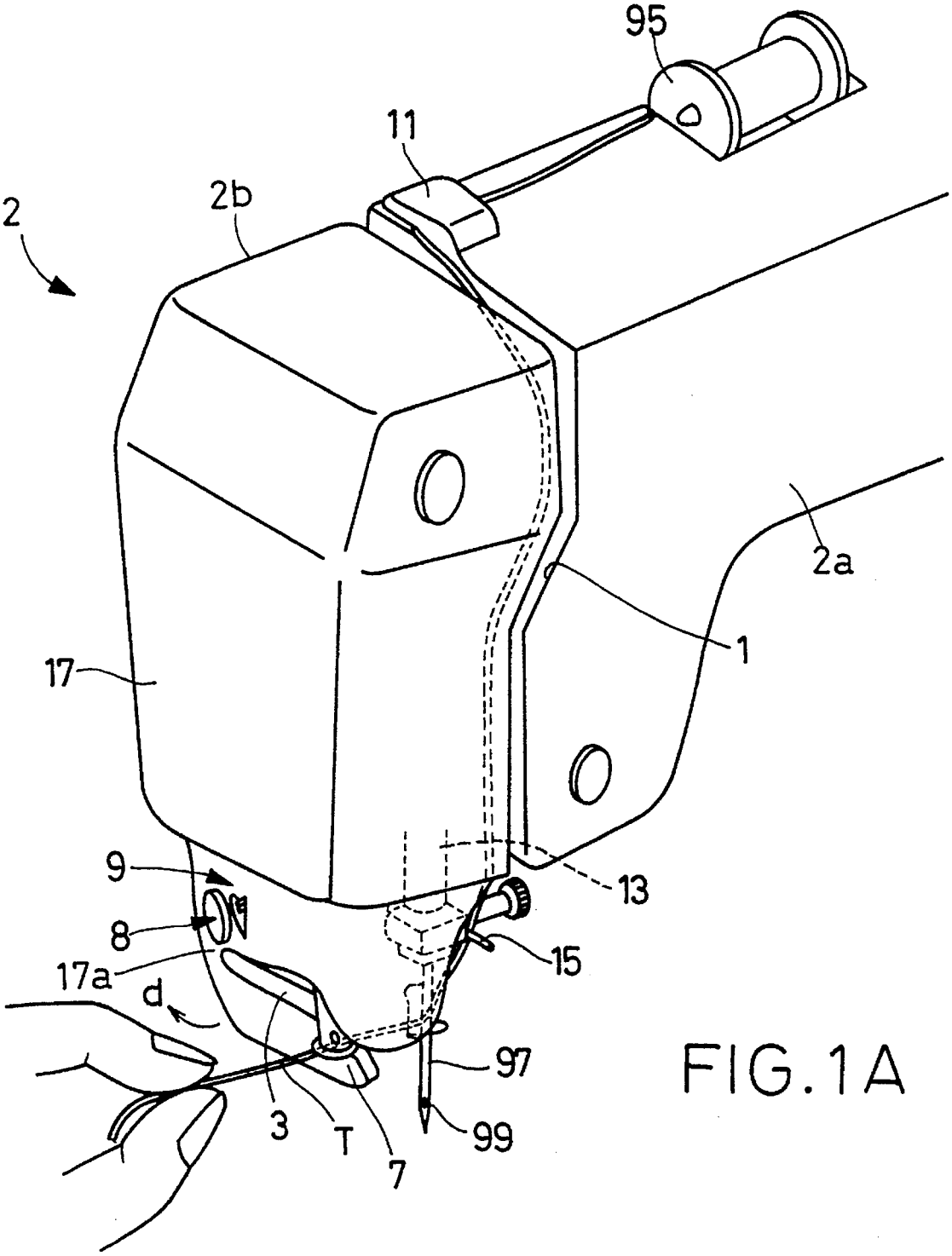
FIG. 1A is a schematic perspective view of a sewing head of a sewing machine which includes a thread-end treating apparatus to which the present invention is applied.

The thread-end treating apparatus 10 is employed as part of a threading apparatus of the sewing machine. FIG. 1A shows a sewing head 2 of the sewing machine which supports the threading apparatus including the thread-end treating apparatus 10.

The thread-end treating apparatus 10 includes a thread guiding device which guides a sewing thread, T, supplied from a thread supplying device (e.g., thread reel or spool) 95, along a thread guiding route passing near a sewing needle 97 having an eye hole 99. The thread guiding device includes a first thread guide groove 1, a needle-bar thread guide member 15 secured to a needle bar 13, a thread engaging device 5, and a second thread guide groove 3. The sewing thread T of the thread reel 95 is stretched by a user of the sewing machine, along the thread guiding route passing in front of the sewing needle 97, before commencement of a sewing operation of the sewing machine. The thread engaging device 5 is provided between the first and second thread guide grooves 1, 3, in the thread guiding route.

Figure 1B:
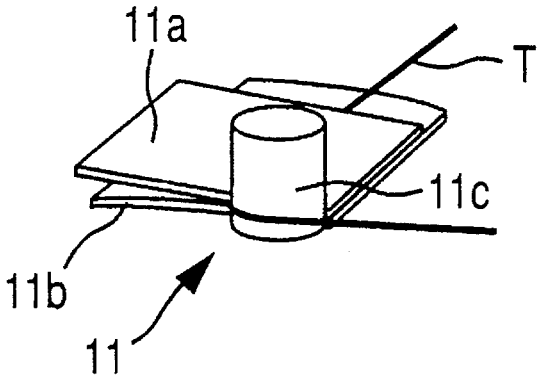
FIG. 1B is a view of an upstream holding device of the thread-end treating apparatus of FIG. 1.

The thread-end treating apparatus 10 additionally includes an intermediate, movable holding device 7 provided adjacent to the second thread guide groove 3, and a downstream holding device 8 and a thread cutting device 9 each provided in the vicinity of a rear end position of the second guide groove 3. The downstream holding device 8 and the thread cutting device 9 are fixed to a side surface 17*a* of a cover member 17 which covers the sewing head 2 of the sewing machine. The thread-end treating apparatus 10 further includes an upstream holding device 11. As shown in FIG. 1B, the upstream holding device 11 includes a sheet spring 11*a* formed of a metal sheet, a holding member 11*b* which cooperates with the sheet spring 11*a* to hold the sewing thread T supplied from the thread reel 95, with a first holding force, and a guide member 11*c* which guides the sewing thread T coming out from between the sheet spring 11*a* and the holding member 11*b*.

The sewing head 2 of the sewing machine has a front surface 2*a* and a rear surface 2*b* which are opposite to each other and extend substantially parallel to each other. When the user operates the sewing machine, he or she faces the front surface 2*a* of the sewing head 2. In this state, the user can see the front surface 2*a* but cannot see the rear surface 2*b*, and can see the downstream holding device 8 and the thread cutting device 9 fixed to the side surface 17*a*, by moving his or her head leftward in FIG. 1A.

Figure 1C:
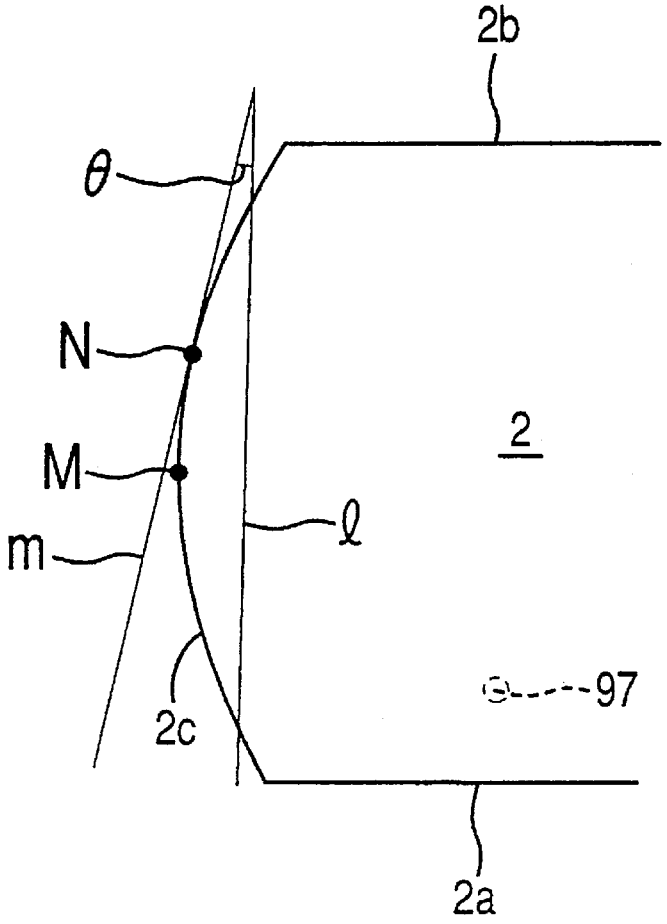
FIG. 1C is a plan view of a sewing head of another sewing machine to which another thread-end treating apparatus in accordance with the present invention is applied.

The side surface 17*a* of the sewing head 2 of the sewing machine to which the present thread-end treating apparatus 10 is applied, is substantially flat and substantially perpendicular to the front and rear surfaces 2*a*, 2*b* of the sewing head 2. However, as shown in FIG. 1C, the thread-end treating apparatus 10 may be applicable to a sewing head of another sewing machine which head has a curved side surface 2*c* (e.g., a part-cylindrical surface). In the latter case, the downstream holding device 8 and the thread cutting device 9 may be fixed at any position on a front half of the side surface 2*c*, or at any position on a rear half of the same 2*c* between a middle position, M, and a rear limiting end position, N. An angle, θ, contained by a tangent plane, m, tangent to the curved surface 2*c* at the rear end position N, and a reference plane, l, extending parallel to the sewing needle 97 and perpendicular to the front and rear surfaces 2*a*, 2*b*, is pre-determined to be not greater than 30 degrees, more preferably, 15 degrees. In the case where the devices 8 and 9 are provided within the range between the positions M, N on the curved side surface 2*c*, the user can see those devices 8, 9 by moving his or her head over the side surface 2*c* by an appropriate distance.

As shown in FIG. 1A, the first thread guide groove 1 extends downward from the upstream holding device 11 provided on a top of the sewing machine, toward a bed portion (not shown) of the sewing machine, and reaches a position near the needle-bar thread guide member 15 secured to the needle bar 13. Meanwhile, the second thread guide groove 3 extends slightly obliquely upward and rearward, from a front end position thereof on the side of the front surface 2*a*, to the rear end position thereof beyond a middle position of the side surface 17*a* and near the rear surface 2*b*. Thus, the second guide groove 3 is inclined with respect to a horizontal plane.

The thread engaging device 5 and the movable holding device 7 of the thread-end treating device 10 are also parts of the threading apparatus of the sewing machine, respectively. The threading apparatus will be described below by reference to FIG. 2.

The threading apparatus includes a threading bar 29 which extends through a base member 27 fixed to a frame member (not shown) of the sewing machine, and is supported by the same 27 such that the threading bar 29 is rotatable about an axis line thereof and is movable upward and downward along the axis line. The needle bar 13 also extends through the base member 27, and is supported by the same 27 such that the needle bar 13 is movable upward and downward along an axis line thereof parallel to the axis line of the threading bar 29. A hook support member 31 is fixed to a lower end portion of the threading bar 29, and a hooking device 33 is secured to the supporting member 31 such that the hooking device 33 extends horizontally from the support member 31.

Figure 3A:
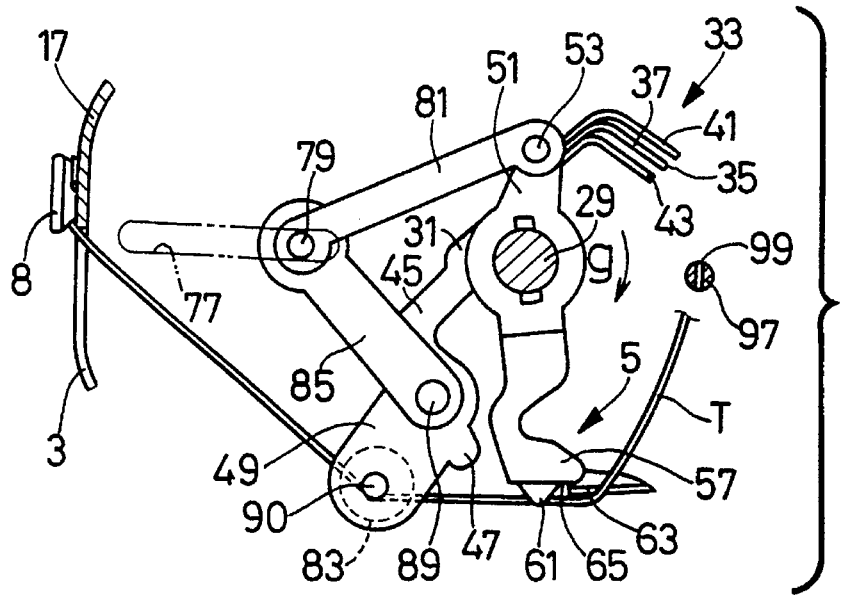
FIG. 3A is a view showing a first operative state of the threading apparatus of FIG. 2.
Figure 3B:
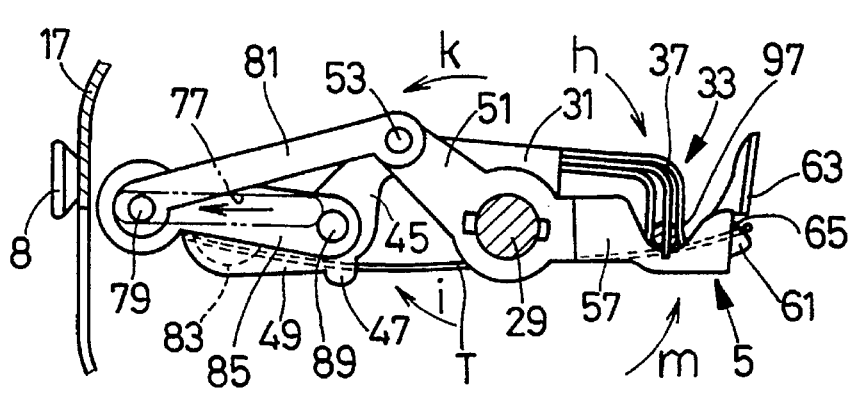
FIG. 3B is a view showing a first operative step and a second operative state of the threading apparatus.
Figure 3C:
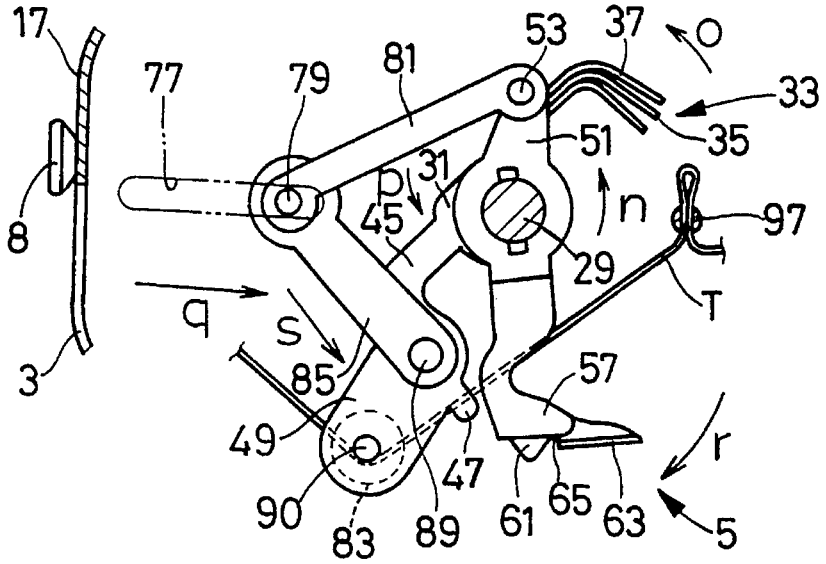
FIG. 3C is a view showing a second operative step and the first operative state of the threading apparatus.
Figure 4A:
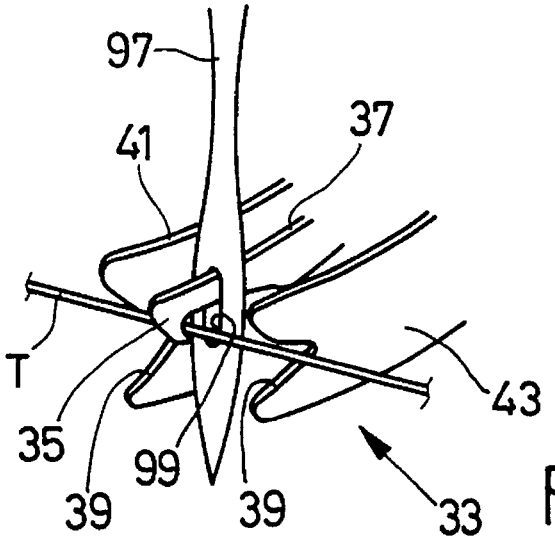
FIG. 4A is a view showing a first operative step of a hooking device of the threading apparatus of FIG. 2.
Figure 4B:
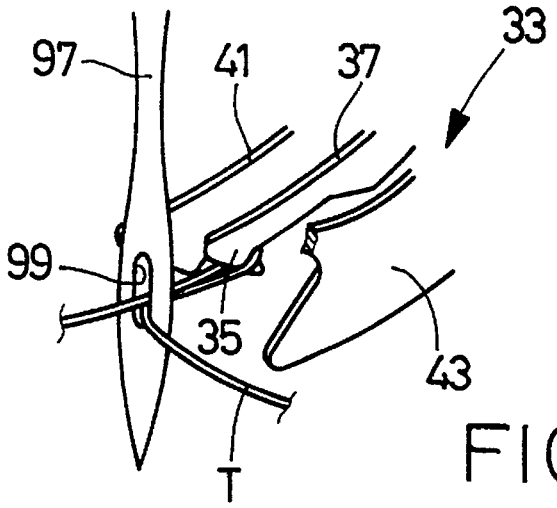
FIG. 4B is a view showing a second operative step of the hooking device.
Figure 4C:
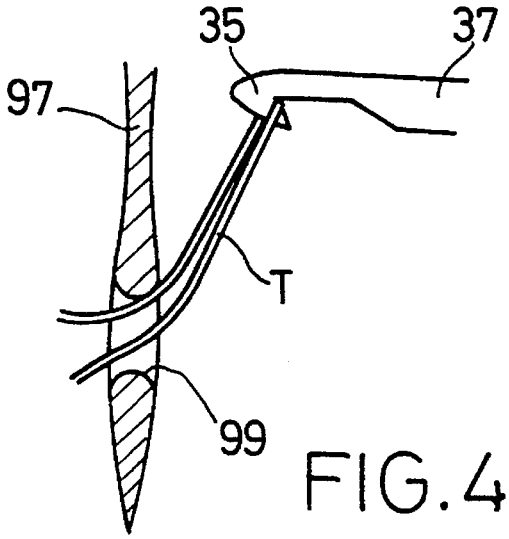
FIG. 4C is a view showing a third operative step of the hooking device.

As shown in FIGS. 3A, 3B, and 3C, the hooking device 33 includes a threading hook 37 and a pair of hook guard members 41, 43 provided on both sides of the hook member 37. The hook member 37 and the two guard members 41, 43 are bent, at respective base portions thereof, substantially rectangularly with respect to the hook support member 31. As shown in FIGS. 4A, 4B, and 4C, the threading hook 37 has a curved hook portion 35 at a free end thereof. Each of the two hook guards 41, 43 has a V-shaped thread guide groove 39.

An extension 45 is integral with the hook support member 31 such that the extension 45 extends in a horizontal direction opposite to the horizontal direction in which the hooking device 33 extends from the support member 31. The extension 45 supports a thread guide portion 47 and the movable holding device 7. The movable holding device 7 includes an inclined thread holding member 49 which extends slightly obliquely downward from the horizontal extension 45 so that a free end of the inclined holding member 49 is lower than the extension 45.

A U-shaped link lever 51 is attached to the lower end portion of the threading bar 29 such that an upper and a lower arms of the link lever 51 are supported by an upper and a lower end of the hook support member 31, respectively, and such that the link lever 51 is rotatable relative to the threading bar 29. A vertical pin 53 extends through an end portion of a horizontal portion of the link lever 51, to connect the link lever 51 to one end of a first link plate 81 of a link mechanism (described later). The thread engaging device 5 is fixed to a back surface of the U-shaped portion of the link lever 51.

Figure 5:
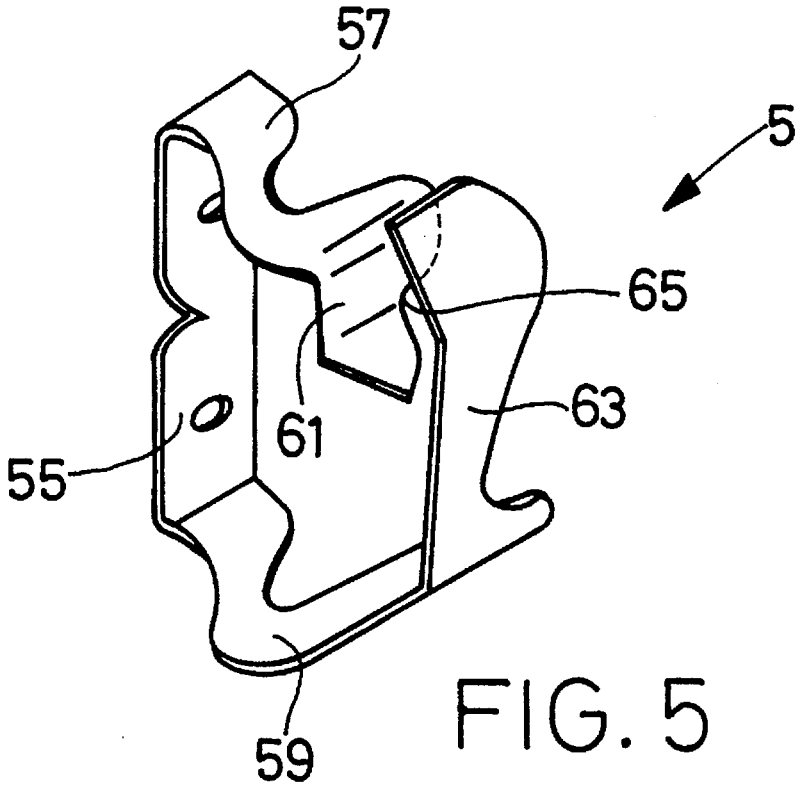
FIG. 5 is a perspective view of a guiding member of the thread-end treating apparatus of FIG. 2.

As shown in FIG. 5, the thread engaging device 5 includes a plate-like portion 55 fixed to the back surface of the link lever 51; an upper and a lower arm 57, 59 which extend horizontally from an upper and a lower end of the plate-like portion 55, respectively, and are curved at respective middle portions thereof; a hold-down tongue 61 which extends downward from a protruded end of the upper arm 57; and a thread-guide tongue 63 which extends upward from a protruded end of the lower arm 59. The plate-like portion 55, two arms 57, 59, and two tongues 61, 63 are formed as respective integral portions of a single thread guiding member 5. The free end of the hold-down tongue 61 is bent outward away from the plate-like portion 55, and a thread-guide groove 65 is formed at a position where the tongue 61 is bent.

As shown in FIG. 2, a guide member 67 rotatably fits, at a base portion thereof, on a portion of the threading bar 29 above the hook support member 31, such that the guide member 67 extends in a direction away from the needle bar 13. Movement of the guide member 67 along the axis line of the threading bar 29 is inhibited by two E-shaped rings 69 engaged with an upper and a lower end of the guide member 67. A support frame 73 which extends parallel to the threading bar 29 and has a vertical groove 71 is fixed to the guide member 67. A pin 75 which extends from the base member 27 is engaged with the vertical groove 71 of the frame member 73. Accordingly, when the threading bar 29 is moved upward and downward, the guide member 67 and the frame member 73 are moved upward and downward together with the bar 29. However, when the bar 29 is rotated, neither the guide member 67 nor the frame member 73 is rotated.

The guide member 67 has a guide groove 77 formed therein and having a predetermined length. A link pin 79 as part of the link mechanism is engaged with the guide groove 77 such that the link pin 79 is movable along the guide groove 77 relative to the guide member 67. The link pin 79 connects a first link plate 81 and a second link plate 85 such that each link plate 81, 85 is rotatable about the link pin 89. As shown in FIG. 3A, the link pin 79 and the pin 53 fixed to the link lever 51 extend through opposite end portions of the first link plate 81, respectively, such that each pin 79, 53 is rotatable relative to the first link plate 81.

A pin 89 rotatably extends through one of the opposite end portions of the second link plate 85 which portion is opposite to the other end portion thereof through which the link pin 79 rotatably extends. The pin 89 is fixed to the horizontal extension 45 of the hook support member 31.

Thus, the link mechanism is provided by the first and second link plates 81, 85 connected to each other by the link pin 79, the link lever 51 connected to the first link plate 81 by the pin 53, and the horizontal extension 45 connected to the second link plate 85 by the pin 89.

Figure 6A:
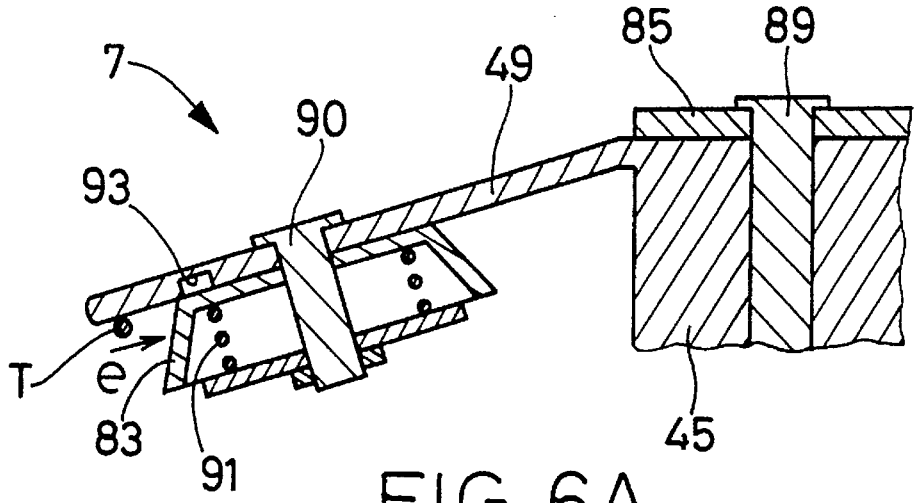
FIG. 6A is a view showing a first operative state of a movable holding device of the thread-end treating apparatus of FIG. 2.

The movable thread holding device 7 includes the inclined thread holding member 49 integral with the horizontal extension 45. As shown in FIG. 6A, the inclined holding member 49 extends slightly obliquely downward from the horizontal extension 45, and an axis pin 90 extends through an end portion of the holding member 49. A holding pan 83 is supported by the axis pin 90 such that the axis pin 90 extends through the holding pan 83 and the holding pan 83 is movable along or on the axis pin 90. A coil spring 91 is provided to bias the holding pan 83 against the holding member 49, so that the holding pan 83 is held in pressed contact with the holding member 49. The movable holding device 7 holds the sewing thread T with a second holding force smaller than the first holding force of the upstream holding device 11. A curved thread releasing groove 93 is formed in the holding member 49 in a predetermined positional relationship with the axis pin 90. The thread releasing groove 93 is formed substantially along the thread guiding route, so that when the sewing thread T falls in the groove 93, the thread T can easily be drawn out of the movable holding device 7 by the threading hook 37 of the hooking device 33, as described later.

Next, the downstream holding device 8 and the thread cutting device 9 will be described. The downstream holding device 8 and the thread cutting device 9 are provided on the externally visible side surface 17*a* of the cover member 17 which covers the sewing head 2, at respective positions above the rear end of the second thread guide groove 3. The thread cutting device 9 is provided at the position higher than that of the downstream holding device 8, and on a front side of the same 8 where the movable holding device 7 is provided. The downstream holding device 8 has a construction similar to that of the movable holding device 7, but does not have any groove like the thread releasing groove 93. Specifically, the downstream holding device 8 includes a holding pan and a horizontal axis pin like the holding pan 83 and axis pin 90 of the movable holding device 7, and a coil spring for biasing the holding pan along the axis pin toward the side surface 17*a* of the cover member 17. The downstream holding device 8 holds the sewing thread T with a third holding force smaller than the second holding force of the movable holding device 7. The thread cutting device 9 is provided on a downstream side of the downstream holding device 8 in the thread guiding route, and has a cutting blade 9*a* which is oriented upward. Thus, the sewing thread T being guided through the rear end of the second thread guide groove 3 is partially (about half) wound around the axis pin of the downstream holding device 8 and then is turned toward the thread cutting device 9. Since the distance between the thread cutting device 9 and the needle eye 99 in the thread guiding route does not change, a predetermined length of the thread T is obtained when the user cuts off an excessive length of the thread T with the cutting device 9, so that the predetermined length of the thread T is drawn through the needle eye 99. The sewing thread T is securely held by the downstream holding device 8, and the holding device 8 holds a remaining end portion of the thread T cut by the cutting device 9.

Next, there will be described a thread stretching operation carried out by the user before commencement of the sewing operation of the sewing machine.

As shown in FIG. 1A, the user of the sewing machine prepares the needle thread T supplied from the thread spool 95 in the following manner: First, the sewing thread T is held between the sheet spring 11*a* and holding member 11*b* of the upstream holding device 11 and is engaged with the guide member 11*c* of the same 11. Subsequently, the thread T is introduced into the first thread guide groove 1, and then is engaged with the needle-bar thread guide member 15. Next, the end portion of the sewing thread T is drawn leftward to be introduced into the second thread groove 3. In this step, the thread T is guided by a top surface of the thread-guide tongue 63 and then an bottom surface of the curved end portion of the thread hold-down tongue 61. Thus, the thread T is engaged with the thread-guide tongue 63, as shown in FIG. 2. The thread T is additionally engaged with the movable holding device 7.

Subsequently, when the sewing thread T is pulled in a direction indicated at arrow, d, in FIG. 1A, the thread T slides on a lower surface of the end portion of the inclined thread holding member 49, in a direction indicated at arrow, e, in FIG. 6A, so that the thread T is provisionally held between the holding pan 83 and the holding member 49. When the thread T is further pulled in the direction d in FIG.

Figure 6B:
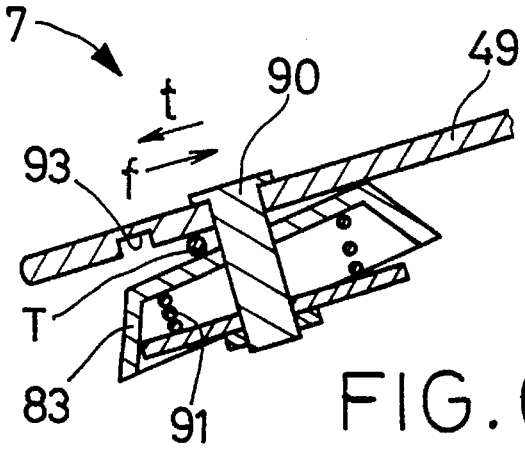
FIG. 6B is a view showing a second operative state of the movable holding device.

1A, the thread T moves toward the axis pin 90 in a direction indicated at arrow, f, in FIG. 6B. Thus, the thread T is more securely held by the movable holding device 7.

At the end of the thread stretching operation, the sewing thread T is moved to the rear end of the second thread groove 3, so that the thread T is held by the downstream holding device 8 and an excessive length of the thread T is cut off by the cutting device 9 provided on the downstream side of the downstream holding device 8. Thus, this thread stretching operation can be completed in a single action of conveying the thread T along the first and third thread guide grooves 1, 3. In this state, since the movable holding device 7 has not been moved yet, i.e. is located at an initial position thereof, the distance between the thread cutting device 9 and the movable holding device 7 has not been changed. Therefore, if an excessive length of the thread T is cut off by the cutting device 9, a remaining length of the thread T as measured from the cut end thereof to the movable holding device 7 has a predetermined length.

FIGS. 2 and 3(A) shows the sewing machine on which the thread stretching operation has been completed.

Next, there will be described the operation of the threading apparatus including the thread-end treating apparatus 10. This operation is effected based on the vertical and rotary movements of the threading bar 29, and the movements of the threading bar 29 are controlled by a known control mechanism which is disclosed in, e.g., Examined Japanese Utility Model Application that was filed by the Assignee of the present application and was laid open for opposition under Publication No. 61(1986)-35188. The following description will particularly be focused on the movements or operations of respective parts of the threading apparatus.

After the thread stretching operation has been completed as described above, the user operates an operative lever (not shown) to move the threading bar 29 downward and additionally rotate the bar 29 in a direction indicated at arrow, g, in FIG. 3A. Accordingly, the hooking device 33 and the extension 45 fixed to the threading bar 29 are rotated with the bar 29, in directions indicated at arrows, h, i, in FIG. 3B, respectively, so that the hook portion 35 of the threading hook 37 of the hooking device 33 goes through the eye hole 99 of the sewing needle 97. When the extension 45 is rotated, the link pin 79 movably engaged with the guide groove 77 of the guide member 67 is moved in a direction indicated at arrow, j, via the second link plate 85, and the pin 53 is moved in a direction indicated at arrow, k, via the first link plate 81. Accordingly, the link lever 51 is rotated in the direction k, so that the thread engaging device 5 fixed to the back of the link lever 51 is rotated in a direction indicated at arrow, m. Consequently the thread engaging device 5 is moved toward the sewing needle 97, so that the sewing thread T is stretched in front of the needle eye 99, and the hook portion 35 of the threading hook 37 catches the thread T, as shown in FIG. 3B.

In the above step, the tension of the sewing thread T is increased because the thread T is held by the upstream holding device 11 with the first holding force and is stretched out by the movement of the movable holding device 7 which holds the thread T with the second holding force smaller than the first holding force. The movable holding device 7 is movable between an upstream-side position thereof shown in FIG. 3A and a downstream-side position thereof shown in FIG. 3B. The distance between the upstream-side and downstream-side positions of the movable holding device 7 is not smaller than a distance between the downstream holding device 8 and the thread cutting device 9. When the thread engaging device 5 is rotated in the direction m, the thread-guide tongue 63 slides on the sewing thread T in an upstream direction of the thread guiding route toward the thread supplying device 95, so as to eliminate any looseness of the thread T. Thus, the sewing thread T is tensioned between the upstream holding device 11 and the movable holding device 7. When the thread engaging device 5 is further rotated and the thread-guide tongue 63 approaches the sewing needle 97, the needle thread T comes off the thread-guide tongue 63 and is introduced into the guide groove 65 of the hold-down tongue 61, so that the thread T is tensioned between the guide groove 65 and the movable holding device 7 and is placed in front of the needle eye 99 as shown in FIG. 3B. FIG. 4A shows this state in which the hook portion 35 of the threading hook 37 advances through the needle eye 99 and the tensioned thread T is caught by the hook or notch portion 35 of the hook member 37.

When the movable holding device 7 is rotated in the direction i, the sewing thread 7 held by the holding device 7 is tensioned and naturally slides, because of an increased tension thereof, on the lower surface of the inclined holding member 49 toward the axis pin 90 in the direction of arrow f in FIG. 6B. Finally, the sewing thread T is securely held between the holding portion 49 and holding pan 83 of the movable holding device 7, with the second holding force greater than the third holding force of the downstream holding device 8. Since the sewing thread T is tensioned with a sufficiently great force between the thread engaging device 5 and the movable holding device 7, the thread T is easily introduced into the respective guide grooves 39 of the hook guard plates 41, 43 and is securely caught by the hook portion 35 of the hook member 37. Since the cut end portion of the sewing thread T is held by the downstream holding device 8, a length of the thread T from the cut end thereof to the needle eye 99 does not change in every threading operation.

When the threading bar 29 is rotated back in the direction of arrow n in FIG. 3C, the hooking device 33 is moved away from the sewing needle 97 in the direction of arrow o, and the extension 45 is rotated in the direction of arrow p. Stated differently, the respective elements of the ink mechanism move back in directions opposite to the directions in which those elements move in FIG. 3A, so that the movable holding device 7 moves in the direction of arrow q and the thread engaging device 5 is rotated and moved away from the sewing needle 97. Consequently, the needle thread T being engaged with the thread-guide groove 65 of the thread engaging device 5 is released from the same 65 because of the above-indicated movements of the devices 7, 5. In addition, since the third thread holding force of the downstream holding device 8 is smaller than the second thread holding force of the movable holding device 7, the sewing thread T with the free end cut by the cutting device 9 is drawn out of the downstream holding device 8. Thus, as shown in FIG. 4B, the sewing thread T caught by the hook member 37 is drawn out through the eye hole 99 of the sewing needle 97. Because of the drawing action of the hook member 37, the sewing thread T is bent by the hook portion 35 of the hook member 37, so that the looseness of the sewing thread T between the hook portion 35 and the movable holding device 7 is eliminated and the thread T is tensioned again.

Figure 6C:
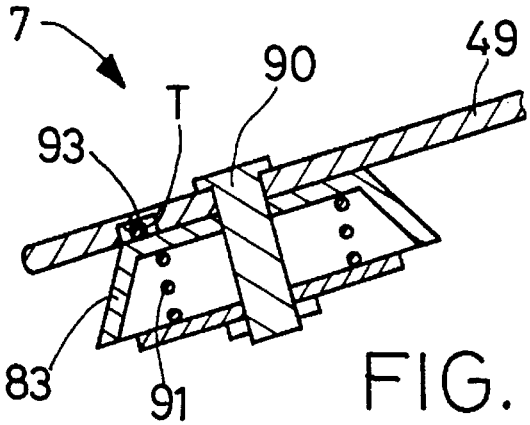
FIG. 6C is a view showing a third operative state of the movable holding device.

When the hook member 37 is further moved in the direction of arrow o in FIG. 3C, the sewing thread T held by the movable holding device 7 slides relative to the same 7 in the direction of arrow s, because the second thread holding force thereof is overcome by the drawing force of the hook member 37. Since a wedge-like space is currently provided between the holding pan 83 and holding member 49 of the movable holding device 7, as shown in FIG. 6B, the sewing thread T moves in an direction indicated at arrow, t, so that the thread T falls in the thread releasing groove 93 of the holding member 49, as shown in FIG. 6C. Consequently, the sewing thread T is released from the biasing force of the holding pan 83, i.e., the second thread holding force of the movable holding device 7, so that the thread T can easily move in the releasing groove 93 with substantially no resistance being exerted thereto. Thus, the tension of the sewing thread T between the movable holding device 7 and the hook member 37 is reduced or relaxed, so that the thread T is easily drawn out of the movable holding device 7 and then through the eye hole 99 of the sewing needle 97 as a result of the drawing movement of the hook member 37.

The threading bar 29 is moved upward after being rotated back by a predetermined angle. When the threading bar 29 is moved upward, the hooking device 33, the thread engaging device 5, the movable holding device 7, and the link mechanism are moved as a unit with the bar 29. The sewing thread T caught by the hook portion 35 of the hook member 37 is drawn up as shown in FIG. 4C, so that the end portion of the thread T is then drawn through the needle eye 99. While the sewing thread T is drawn up, the hook member 37 will eventually become unable to hold the thread T because of the friction force produced between the thread T and the needle eye 99 and the gravity exerted thereto. Thus, the sewing thread T is naturally released from the hook portion 35 of the hook member 37.

As is apparent from the foregoing description, the present thread-end treating apparatus 10 enjoys the following advantages:

When the end portion of the sewing thread T drawn from the thread spool 95 is stretched along the thread guiding route before the commencement of the sewing operation, first, the thread T is engaged with the thread engaging device 5 and is held by the movable holding device 7. The thread T is further drawn in the downstream direction along the thread guiding route, so that the thread T is held by the downstream holding device 8. An excessive length of the thread T may, or may not, be cut off by the thread cutting device 9 provided on the downstream side of the downstream holding device 8. Since the end portion of the thread T is securely held by the downstream holding device 8, the user may, or may not, cut off the excessive length of the thread T. In the former case, the downstream holding device 8 holds a remaining end portion of the thread T cut by the cutting device 9. The cutting of the thread T can easily be carried out by slightly pulling the thread T from the downstream holding device 8 and just pressing the thread T against the blade 9*a* of the cutting device 9. The downstream thread holding device 8 and the thread cutting device 9 are provided around the side surface 17*a* of the head cover member 17 which surface is easily visible from the user who operates the sewing machine while facing the front surface 2*a* of the sewing head 2. That is, the user can carry out the thread cutting operation while viewing both the end portion of the sewing thread T and the thread cutting device 9.

Figure 7A:
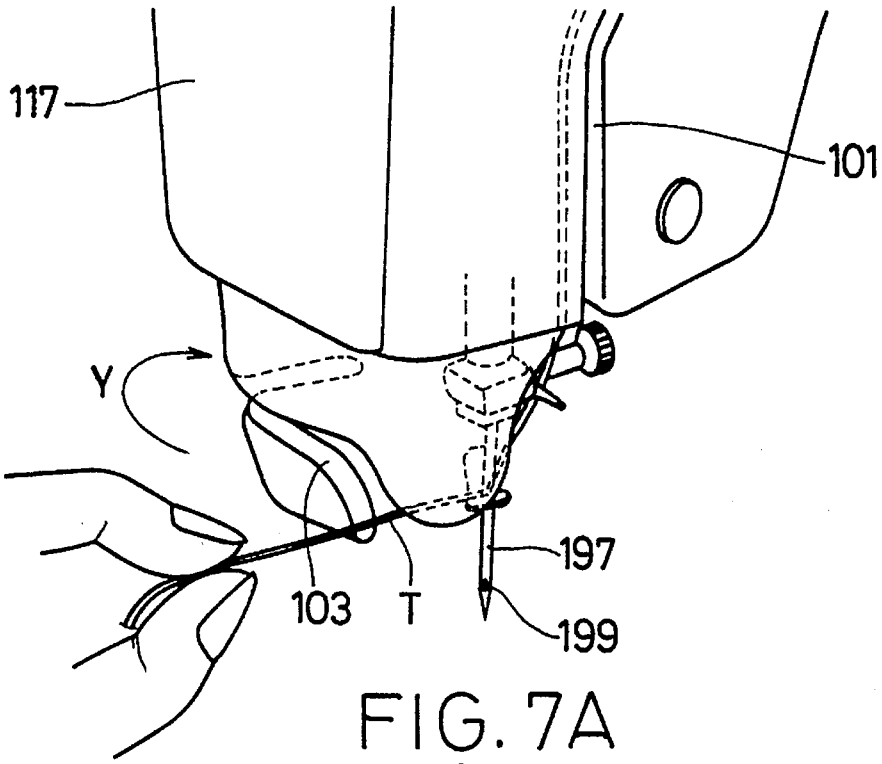
FIG. 7A PRIOR ART
FIG. 7A is a view corresponding to FIG. 1, showing the sewing head of a prior sewing machine which includes a conventional thread-end treating apparatus.
Figure 7B:
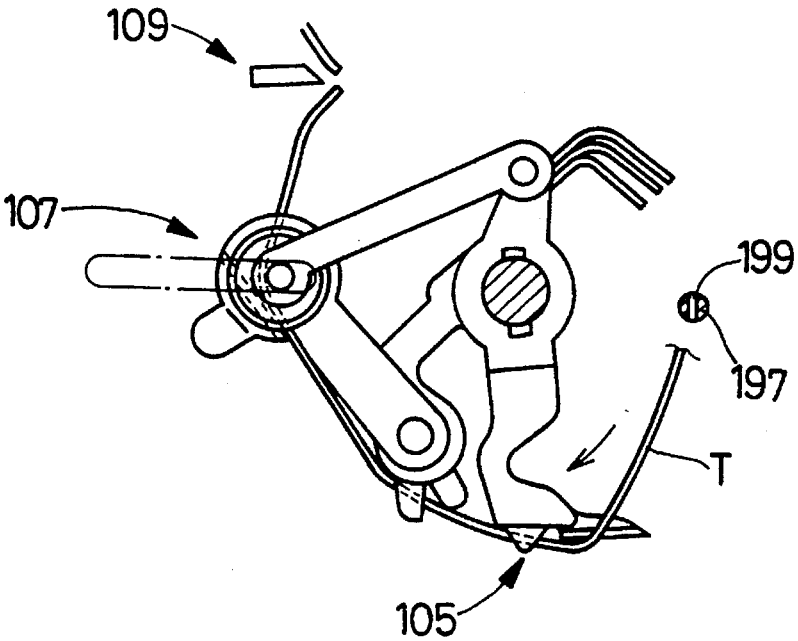
FIG. 7B PRIOR ART
FIG. 7B is a view corresponding to FIG. 3(A), showing an operative state of the conventional thread-end treating apparatus.

Thus, the user can carry out the thread-end treating operation without having to move around to the back of the sewing machine. This contributes to improving the reliability and operability of the sewing machine. In the prior sewing machine shown in FIGS. 7A and 7B, the thread cutting device 109 is provided in the back of the sewing machine, and a user cannot perform a thread-end cutting or treating operation without moving around to the back of the sewing machine. Otherwise, the user must feel his or her way to do the thread cutting. In contrast, with the sewing machine provided with the present thread-end treating apparatus 10, the user can perform the thread cutting while viewing both the thread cutting device 9 and the sewing thread T, without having to go around to the back of the sewing machine. In this respect, the reliability and operability of the sewing machine are improved.

The thread engaging device 5 and the movable holding device 7 are provided in the intermediate portion of the thread guiding route, and the downstream holding device 8 and the thread cutting device 9 are provided in the downstream portion of the thread guiding route. The sewing thread T is stretched in the downstream direction of the thread guiding route before the commencement of the sewing operation. A series of actions of the user needed to stretch the sewing thread T along the thread guiding route, can be completed by cutting the thread T such that a predetermined length of the thread T is obtained between the cut end thereof and the eye hole 99 of the sewing needle 97. Meanwhile, when the sewing thread T is drawn through the needle eye 99, the thread T held by the movable holding device 7 slides and falls in the thread releasing groove 93, so that the thread T can easily be drawn out of the holding device 7.

As shown in FIGS. 6A–6C, in the movable holding device 7, the biasing spring 91 biases the holding pan 83 against the holding member 49 in a direction inclined by a predetermined small angle relative to a vertical direction, so that the free end of the holding member 49 extends slightly downward. When the thread engaging devise 5 and the movable holding device 7 are moved as a unit along the sewing needle 97 toward an elevation level of the eye hole 99 of the needle 97 so that the threading hook 37 threads the sewing needle 97, one of the opposite end portions of the holding member 49 which portion is nearer to the engaging device 5 than the other end portion thereof goes ahead of the other end portion of the holding member 49 which portion is nearer to the downstream holding device 8, so that the sewing thread T slides, because of an increased tension thereof, on the inclined lower surface of the holding member 49 toward the axis pin 90 in the direction of arrow f in FIG. 6B and the thread T is securely held between the two holding members 49, 83 of the movable holding device 7. Since the end portion of the sewing thread T is held by the downstream holding device 8 and the upstream portion of the thread T is moved downward by the movable holding device 7, the tension of the thread T is increased around the movable holding device 7.

Otherwise, it is possible that the sewing thread T be held deeply adjacent the axis pin 90 between the two holding members 49, 83 of the movable holding device 7, when the thread T is initially stretched by the user along the thread guiding route. To this end, however, the user must strongly pull the thread T toward the axis pin 90. With the illustrated arrangement of the thread-end treating apparatus 10, the user is not required to strongly pull the thread T toward the axis pin 90 when he or she stretches the thread T along the thread guiding route, because the thread T naturally or automatically moves or slides toward the axis pin 90 and is securely held between the two holding members 49, 83 while the threading apparatus is operated to thread the sewing needle 97.

Since the movable holding device 7 has the above-described arrangement, the downstream holding device 8 and the thread cutting device 9 can be provided on a more front portion of the side surface 17*a* of the sewing head 2.

As shown in FIGS. 3A–3C, it can be seen that the greater angle the sewing thread T is bent at the movable holding device 7, the more distance the thread T can slide toward the axis pin 90. Meanwhile, the thread T can easily slide toward the axis pin 90 owing to the above-described arrangement of the movable holding device 7. Thus, in the present thread-end treating apparatus, the downstream holding device 8 and the thread cutting device 9 can to be provided at more front positions on the sewing machine, as compared with the case where the movable holding device 7 holds the sewing thread T with a second holding force applied accurately perpendicularly to a vertical direction.

It is to be understood that the present invention may be embodied with various changes, improvements, and modifications that may occur to those skilled in the art without departing from the scope and spirit of the invention defined in the appended claims.

What is claimed is:

1. An apparatus for treating, before commencement of a sewing operation of a sewing machine including a threading device which puts a sewing thread through an eye hole of a sewing needle, an end portion of the sewing thread so that a predetermined length of the thread is drawn out through the needle eye, the apparatus comprising:

a guiding device which guides, along a thread-guiding route passing near the sewing needle, the sewing thread supplied from a thread supplying device before the commencement of the sewing operation of the sewing machine;

said guiding device including a guiding member which is provided in said thread-guiding route and which engages the sewing thread supplied from the thread supplying device;

an intermediate holding device which is provided on a downstream side of said guiding member in said thread-guiding route and which holds the sewing thread with a biasing force applied substantially perpendicularly to the thread-guiding route;

a cutting device which is provided, on a downstream side of said intermediate holding device in said thread-guiding route, at a position around a visible side surface of the sewing machine, and which cuts off an excessive length of the end portion of the sewing thread held by the intermediate holding device, at said position distant by a predetermined distance from said guiding member in the thread-guiding route; and a downstream holding device which is provided on an upstream side of said cutting device, and on a downstream side of said intermediate holding device, in said thread-guiding route and which holds a remaining end portion of the sewing thread cut by said cutting device, said guiding member being movable toward the sewing needle to stretch a portion of the sewing thread in front of the needle eye, so that the sewing thread is put through the needle eye by the threading device of the sewing machine.

2. An apparatus for treating an end portion of a sewing thread which is supplied from a thread supplying device and is guided by a guiding device to pass near a sewing needle of a sewing head of a sewing machine, the sewing head having a front surface facing a user who operates the sewing machine, a rear surface opposite to the front surface, and a side surface connecting between the front and rear surfaces, the apparatus comprising:

a downstream holding device which holds the end portion of the sewing thread guided by the guiding device, so as to stretch a portion of the sewing thread near the sewing needle; and a cover member which covers the sewing head, said cover member providing the front, rear, and side surfaces of the sewing head, said downstream holding device being provided on a visible portion of said side surface of said cover member which portion is visible from the user facing said front surface of the cover member.

3. An apparatus according to claim 2, wherein said side surface of said cover member comprises a substantially flat surface which is substantially perpendicularly connected to each of said front and rear surfaces of the cover member.

4. An apparatus according to claim 2, wherein said side surface of said cover member comprises a curved surface.

5. An apparatus according to claim 4, wherein said curved surface of said cover member comprises a part-cylindrical surface, said visible portion of said side surface comprising a front half of said part-cylindrical surface on a side of said front surface, and a portion of a rear half of the part-cylindrical surface which portion has a maximum tangent-plane angle of 30 degrees with respect to a reference plane parallel to the sewing needle and perpendicular to said front and rear surfaces parallel to each other.

6. An apparatus according to claim 5, wherein said visible portion of said side surface comprises a portion of said rear half of said part-cylindrical surface which portion has a maximum tangent-plane angle of 15 degrees with respect to said reference plane.

7. An apparatus for treating an end portion of a sewing thread which is supplied from a thread supplying device and is guided by a guiding device along a thread-guiding route passing near a sewing needle of a sewing head of a sewing machine, the sewing head having a front surface facing a user who operates the sewing machine, a rear surface opposite to the front surface, and a side surface connecting between the front and rear surfaces, the apparatus comprising:

an upstream holding device which is fixed on an upstream side of the sewing needle in the thread guiding route and which holds, with a first holding force, the sewing thread supplied from the thread supplying device;

a downstream holding device which is fixed on a downstream side of said upstream holding device in the thread guiding route and which holds the end portion of the sewing thread; and a movable holding device which is provided between said upstream and downstream holding devices in the thread guiding route and which holds the sewing thread with a second holding force smaller than said first holding force, said movable holding device cooperating with said upstream holding device to stretch a portion of the sewing thread near the sewing needle, said movable holding device being movable away from said upstream holding device to a downstream-side position thereof so as to tension the stretched portion of the sewing thread.

8. An apparatus according to claim 7, wherein said downstream holding device holds the end portion of the sewing thread with a third holding force smaller than said second holding force of said movable holding device, the movable holding device being movable away from said downstream-side position thereof near to the downstream holding device, to an upstream-side position thereof so as to draw the end portion of the sewing thread held by the downstream holding device.

9. An apparatus according to claim 8, wherein said downstream holding device holds the end portion of the sewing thread such that not more than a predetermined length of the thread is obtained beyond the downstream holding device, said predetermined length being equal to a distance of movement of said movable holding device from said downstream-side position thereof to said upstream-side position thereof.

10. An apparatus according to claim 9, further comprising a cutting device which is provided at a position distant by not more than said predetermined length from said downstream holding device, and which cuts an excessive length of the end portion of the sewing thread held by the downstream holding device, so that when the movable holding device is moved from said downstream-side position thereof to said upstream-side position thereof, the cut end portion of the sewing thread is drawn out of the downstream holding device.

11. An apparatus according to claim 10, wherein said downstream holding device and said cutting device are provided on a visible portion of the side surface of the sewing head which portion is visible from the user facing the front surface of the sewing head.

12. An apparatus according to claim 7, further comprising a guiding member of the guiding device, said guiding member being provided between said upstream holding device and said movable holding device in the thread guiding route, wherein when the movable holding device is moved away from the upstream holding device to said downstream-side position thereof, the movable holding device is moved away from said guiding member and the guiding member is moved toward the sewing needle, so as to tension said stretched portion of the sewing thread.

13. An apparatus according to claim 12, wherein said movable holding device is provided at a position which is between said guiding member and said downstream holding device in the thread guiding route and is as high as a position of the guiding member, the guiding member and the movable holding device being movable, as a unit, downward along the sewing needle to a level of the eye hole of the needle, the guiding member being further movable to a position adjacent to the eye hole of the needle, so that the end portion of the sewing thread is put through the eye hole of the needle by a threading device of the sewing machine.

14. An apparatus according to claim 13, wherein said guiding member and said movable holding device are supported by a movable bar of the threading device which bar extends parallel to a vertically movable needle bar to which the sewing needle is secured, is vertically movable along the sewing needle, and is rotatable about an axis line thereof to move the guiding member toward the sewing needle and move the movable holding device away from the guiding member, the guiding device and the second holding device providing respective parts of the threading device, the movable holding device being located on a front side of said downstream holding device on which side the user operates the sewing machine.

15. An apparatus according to claim 7, wherein said downstream holding device comprises:

at least one holding member which holds the end portion of the sewing thread;

an axis member which extends through said holding member, the end portion of the sewing thread being partially wound around said axis member; and a biasing member which biases, with said third holding force, said holding member along said axis member toward the side surface of the sewing head, so that the end portion of the sewing thread partially wound around the axis member is held between the holding member and the side surface.

16. An apparatus according to claim 7, wherein said movable holding device comprises:

two holding members which cooperate with each other to hold the end portion of the sewing thread;

an axis member which extends through one of said two holding members, the sewing thread being partially wound around said axis member; and a biasing member which biases, with said second holding force, said one holding member along said axis member toward the other holding member, so that the sewing thread partially wound around the axis member is held between the two holding members.

17. An apparatus according to claim 16, wherein said other holding member of said movable holding device includes a horizontal portion and an inclined portion inclined downward from said horizontal portion, and wherein when the movable holding device is moved downward along the sewing needle toward a level of the eye hole of the needle, the sewing thread held by the movable holding device slides, because of an increased tension thereof, on said inclined portion of said other holding member toward said axis member, so that the sewing thread is held between said two holding members.

18. An apparatus according to claim 17, wherein said other holding member of said movable holding device has a thread groove which permits, when the sewing thread falls therein, the sewing thread to easily be drawn from the movable holding device, so that the end portion of the sewing thread is put through the eye hole of the sewing needle by a threading device of the sewing machine.

19. An apparatus according to claim 17, wherein said inclined surface of said other holding member is inclined such that when said guiding member and said movable holding device are moved as a unit along the sewing needle toward a level of the eye hole of the needle, one of opposite end portions of said other holding member which portion is nearer to the guiding member than the other end portion goes ahead of said other end portion of said other holding member which portion is nearer to said downstream holding device than said one end portion, so that the sewing thread held by the movable holding device slides, because of said increased tension thereof, on said inclined portion of said other holding member toward said axis member.

20. An apparatus according to claim 7, wherein said upstream holding device comprises:

a holding member; and a sheet spring which cooperates with said holding member to hold, with said first holding force, the sewing thread supplied from the thread supplying device.

* * * * *